US005092214A

United States Patent [19]

Flynn

[11] Patent Number: 5,092,214

[45] Date of Patent: Mar. 3, 1992

[54] PITCH CHANGING DEVICE FOR A PEDAL STEEL GUITAR

[76] Inventor: J. Harold Flynn, 4301 E. Emory Rd., Knoxville, Tenn. 37938

[21] Appl. No.: 524,739

[22] Filed: May 17, 1990

[51] Int. Cl.[5] ..... G10D 3/14

[52] U.S. Cl. ..... 84/312 P

[58] Field of Search ..... 84/312 R, 312 P

[56] References Cited

U.S. PATENT DOCUMENTS

| | | | |
|---|---|---|---|
| 2,458,263 | 1/1949 | Harlin | 84/312 R |
| 2,483,617 | 10/1949 | Bradley | 84/312 R |
| 2,973,682 | 3/1961 | Fender | 84/312 P |
| 3,136,198 | 6/1964 | Smith et al. | 84/312 P |
| 3,352,188 | 11/1967 | Fender | 84/312 P |
| 3,390,600 | 7/1968 | Kelley, Jr. | 84/312 P |
| 3,447,413 | 6/1969 | Lashley et al. | 84/312 P |
| 3,688,631 | 9/1972 | Jackson | 84/312 P |
| 3,733,954 | 5/1973 | Fields | 84/312 P |
| 3,785,238 | 1/1974 | Wheeler | 84/312 P |
| 4,007,658 | 2/1977 | Spain | 84/312 R |
| 4,147,086 | 4/1979 | Clough, Jr. | 84/312 P |
| 4,285,262 | 8/1981 | Scholz | 84/313 |
| 4,704,935 | 11/1987 | Franklin | 84/312 P |

*Primary Examiner*—L. T. Hix
*Assistant Examiner*—Howard B. Blankenship
*Attorney, Agent, or Firm*—Pitts and Brittian

[57] ABSTRACT

A pitch changing device for a pedal steel guitar. The pitch changing device (10) includes at least one tension adjusting lever (24) pivotally mounted on the guitar body (14) for anchoring at least one guitar string (17) and selectively increasing or decreasing the tension on the string. At least one bracket assembly is provided including a first bracket (34) pivotally secured to the guitar body so as to selectively pivot at a first pivot point (40), and a second bracket (36) for engaging and pivoting the pitch adjustment lever (24), the second bracket (36) being pivotally secured to the first bracket (34) at a second pivot point (45) displaced from the first pivot point (40). A upper stop member (102) is provided for terminating the travel of the first bracket (34) at a point operatively associated with the normal pitch position of the pitch adjusting lever (24), and a lower stop member (42) is provided for terminating the travel of the second bracket (36) at a point operatively associated with the normal pitch position of the pitch adjustment lever (24). Further, actuator assemblies are provided for selectively pivoting the first and second brackets.

8 Claims, 3 Drawing Sheets

PITCH CHANGING DEVICE FOR A PEDAL STEEL GUITAR

DESCRIPTION

1. Technical Field

This invention relates to a pitch changing device for a pedal steel guitar. In this particular invention the pitch changing device includes a tension adjusting lever selectively pivoted by a pair of brackets, each such bracket having an operatively associated stop member.

2. Background Art

The pedal steel guitar is a lute type instrument which normally comprises one or two necks, each neck having ten or twelve strings. A pedal or lever-actuated pitch changer is generally provided which allows the pitch of selected strings to be raised or lowered in order to expand the number of musical cords available to the player. In this regard, the strings of the steel guitar are normally tuned to a standard tuning wherein the tension on each string is adjusted to produce a selected pitch. Pitch changing devices allow the tension on selected strings or groups of strings to be selectively increased or decreased, thereby selectively altering the pitch of the strings. For example, certain pedal steel guitars and associated pitch changing devices are disclosed in U.S. Pat. Nos. 4,704,935; 4,285,262; 4,147,086; 4,007,658; 3,785,238; 3,733,954; 3,688,631; 3,447,413; 3,390,600; 3,352,188; 3,136,198; 2,973,682; 2,483,617; and 2,458,263.

However, conventional changing devices are plagued by two perennial problems. The first is a failure of the changing mechanism to return the strings to their proper pitch once the changing mechanism is actuated by the pedals and/or levers and then released. The strings commonly return a little below (flat) or above (sharp) their original pitch, thus, leaving the instrument slightly out of tune. The second problem is that when the changer mechanism is actuated to alter the pitch of certain strings, the adjacent strings are also affected by pitch changes, even though they are not being actuated by the changer mechanism.

Therefore, it is an object of the present invention to provide an improved pitch changing device for a pedal steel guitar.

It is another object of the present invention to provide a pitch changing device which returns the strings of the steel guitar to their original pitch after being actuated.

Yet another object of the present invention is to provide a pitch changing device which allows the pitch of selected strings to be altered without affecting the pitch of adjacent, unactuated strings.

Still another object of the present invention is to provide a pitch changing device which is inexpensive to manufacture and maintain.

DISCLOSURE OF THE INVENTION

Other objects and advantages will be accomplished by the present invention which provides a pitch changing device for a pedal steel guitar. The pitch changing device includes at least one tension adjusting lever pivotally mounted on the body of the steel guitar for anchoring at least one guitar string. The tension adjusting lever is positionable in a normal pitch position, and selectively pivotable in a first direction for increasing tension on the string and selectively pivotable in a second direction decreases tension on the string. At least one bracket assembly is provided, the bracket assembly including a first bracket pivotally secured to the body of the guitar so as to selectively pivot at a first pivot point, and a second bracket for engaging the tension adjusting lever, the second bracket being pivotally secured to the first bracket at a second pivot point displaced from the first pivot point. Further, the first bracket is pivotable in a first direction for moving the second bracket against the tension adjusting lever so as to move the lever in a direction for increasing the tension on the string, and pivotable in a second direction for returning the lever to said normal pitch position. The second bracket is pivotable in a first direction for allowing the tension adjusting lever to move in a direction for decrease the tension on the string, and pivotable in a second direction for moving said tension adjusting lever back to the normal pitch position. An upper stop member is provided for engaging the first bracket and for terminating the travel of the first bracket at a point operatively associated with the normal tension position of the pitch adjusting lever, and a lower stop member is provided for terminating the travel of the second bracket at a point operatively associated with the normal pitch position of the tension adjusting lever. Further, actuator assemblies are provided for selectively pivoting the first and second brackets, which in one embodiment include at least one pedal assembly and at least one knee lever assembly.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

A pitch changing device incorporating various features of the present invention is illustrated generally at 10 in the Figures. As indicated above the pitch changing device 10 is designed for use with a pedal steel guitar, and allows the pitch of individual or groups of guitar strings to be selectively raised or lowered while the guitar is being played.

Figure 1:
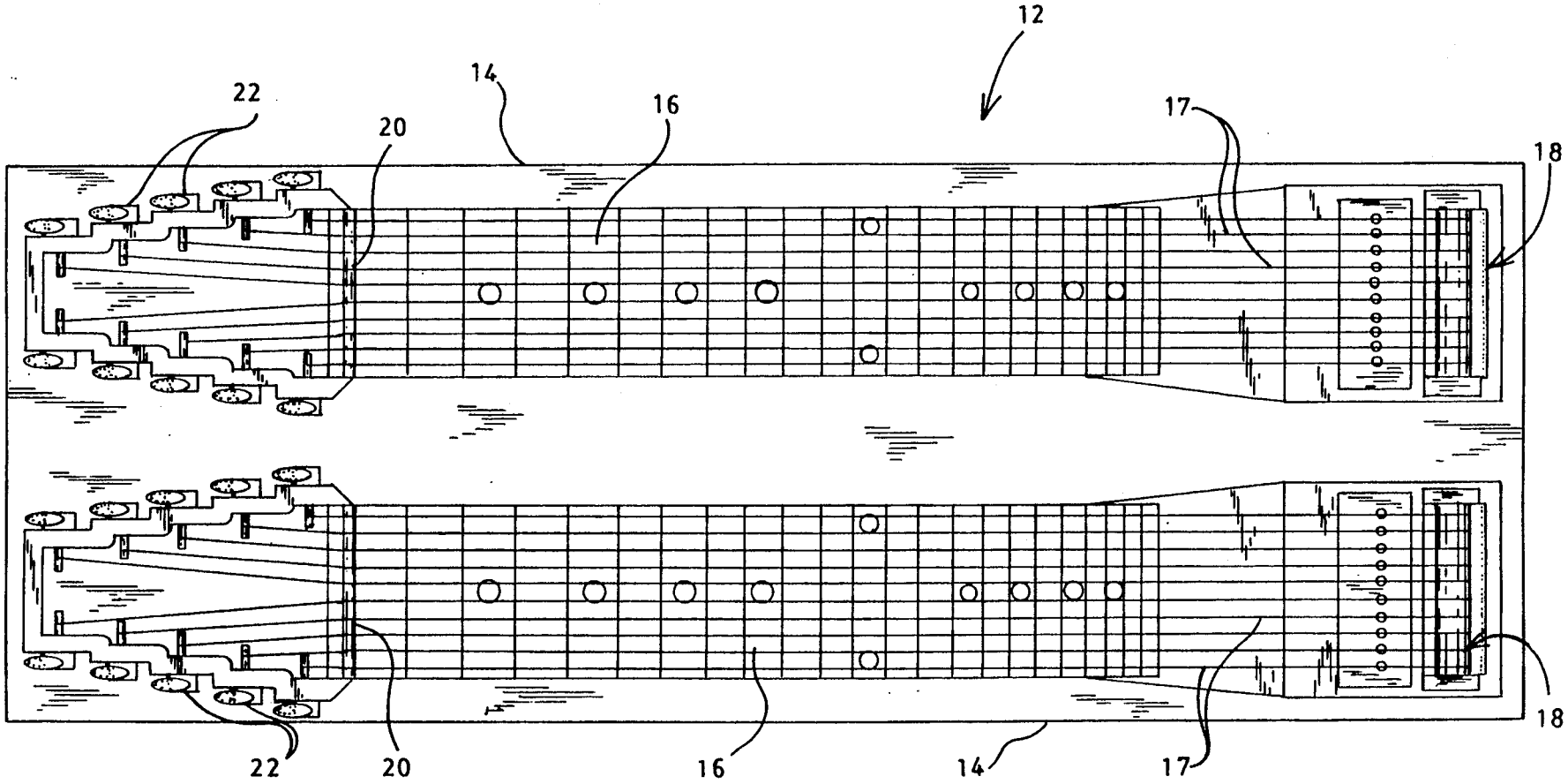
FIG. 1 illustrates a top view of a conventional pedal steel guitar.

As illustrated in FIG. 1, a pedal steel guitar 12 generally comprises a body 14, with one or more finger boards 16. A plurality of guitar strings 17 are mounted above each finger board and extend the length thereof. In this regard, each string 17 is anchored at a first end of the steel guitar by a bridge assembly 18 which, as will be discussed further below, generally comprises a bridge for supporting the strings at a desired height and a separate string anchoring means, or a bridge which incorporates a string anchoring means. At a second end of the steel guitar each string 17 is supported at a desired height by the nut 20 and adjustably anchored to the body 14 by a tuning machine 22 which allows the tension on the string to be altered for tuning purposes.

Figure 2:
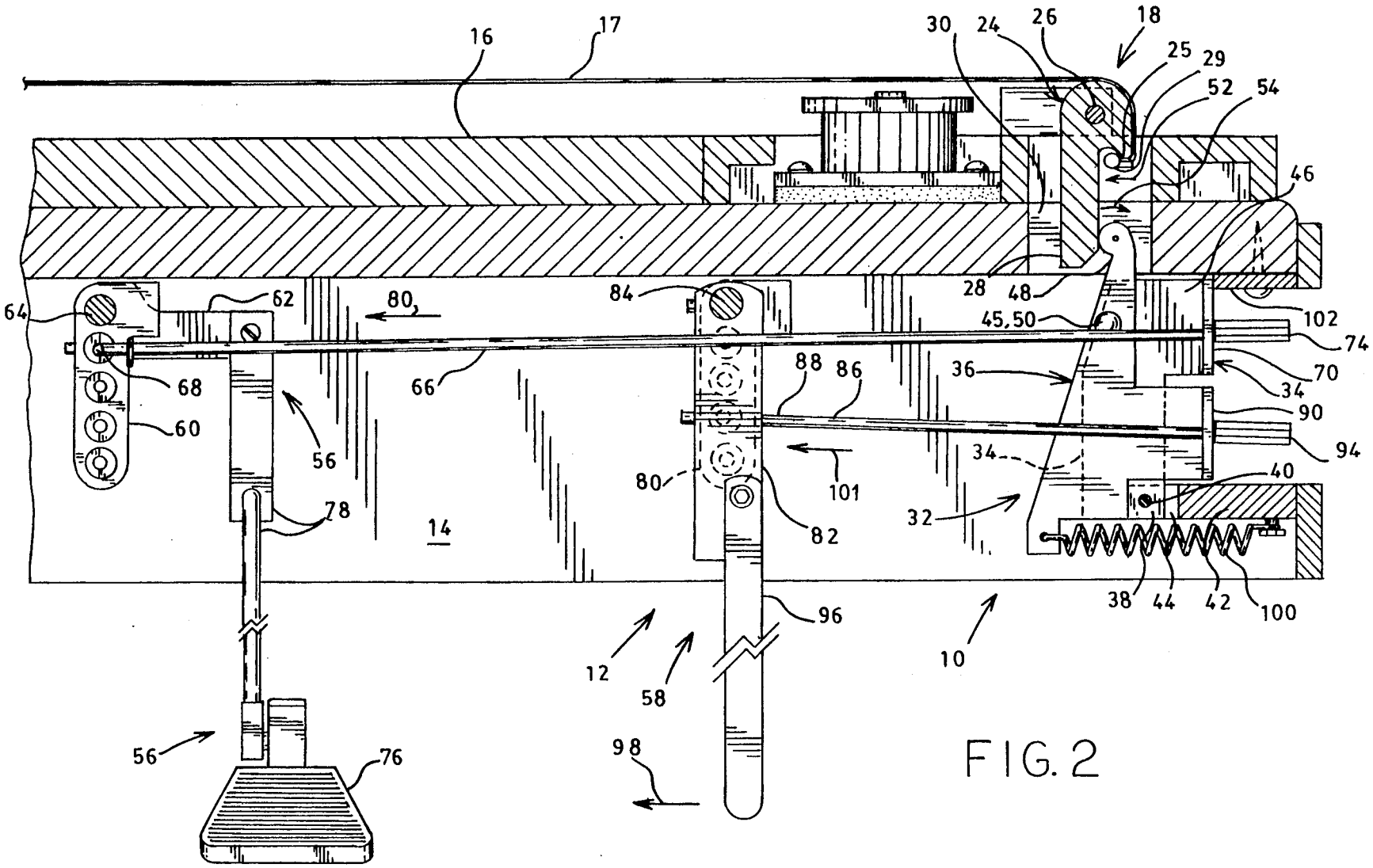
FIG. 2 illustrates a side elevation view, in section, of a pitch changing device of the present invention as it is installed in a pedal steel guitar.

Referring now to FIG. 2, the pitch changing device 10 includes a plurality of tension adjusting levers 24, one such lever 24 being operatively associated with each string 17. In the preferred illustrated embodiment each lever 24 serve both as a bridge for the associated string 17 and as an anchoring means for the string 17. In this regard the string 17 is supported at the desired height by the upper portion of the lever 24, and the string wraps around the rearward portion of the lever 24 where it is routed though a slot 25 and anchored by the retaining nut 29 of the string 17. However, it will be recognized by those skilled in the art that a separate bridge can be provided forward of the levers 24 to support the strings 17 at the desired height such that the levers 24 need not serve this function.

The tension adjusting levers 24 are pivotally mounted on a pivot shaft 26, the shaft 26 being secured to the body 14. It will be noted that the strings 17 engage the levers 24 at a point displaced from the rotational axis of the pivot shaft 26. Accordingly, as the levers 24 are selectively pivoted on the shaft 26 the tension on the operatively associated string changes, thereby changing the pitch of the string.

Figure 3:
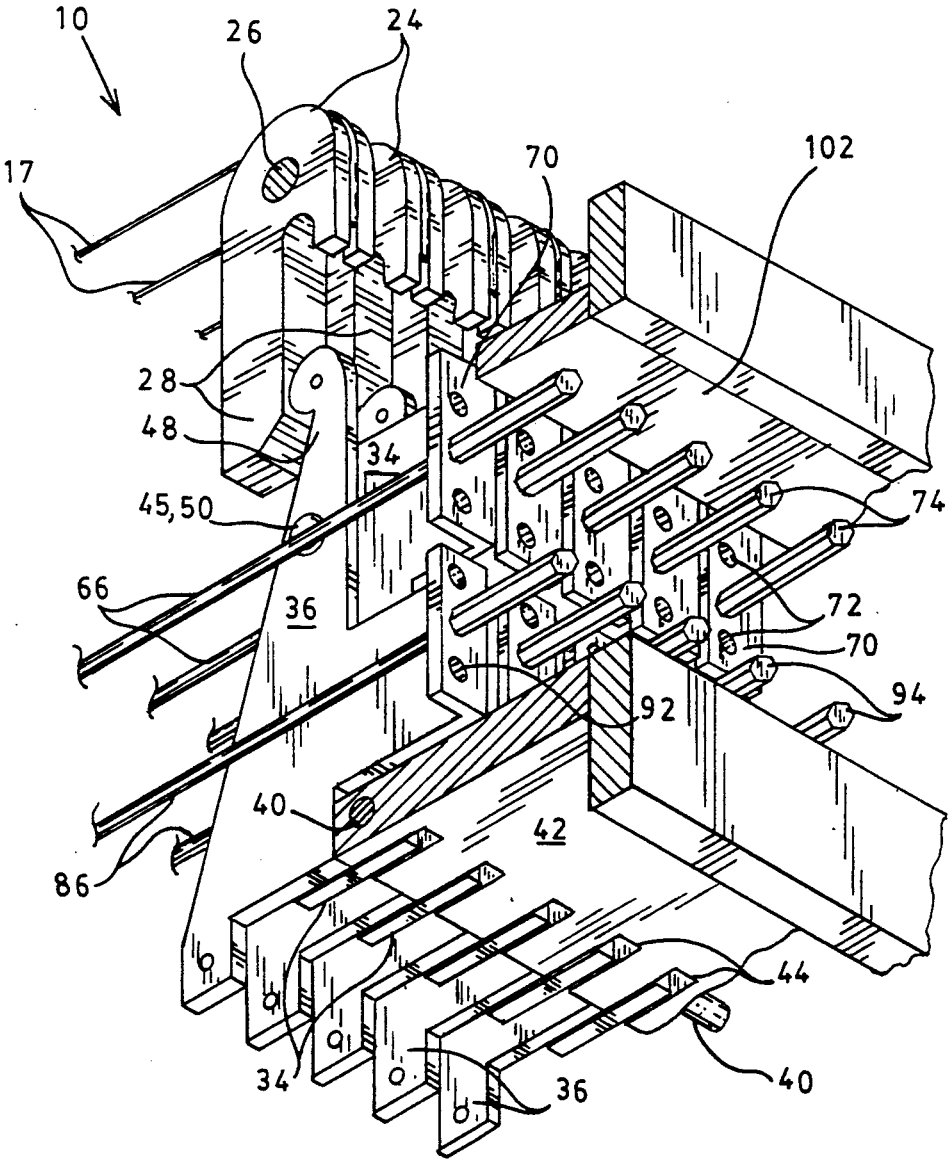
FIG. 3 is a perspective view, in section, of a pitch changing device of the present invention.

In order to facilitate the selective pivoting of the levers 24, each lever 24 is provided with a lever arm 28 which extends downwardly into an opening 30 provided in the body 14 of the steel guitar 12 where it is engaged by a bracket assembly 32. Each of the bracket assemblies 32 includes a first bracket 34 and a second bracket 36. The first bracket 34 is pivotally mounted proximate its lower end portion 38 on a second pivot shaft 40. As best illustrated in FIG. 3, in the preferred embodiment a lower stop member 42 is utilized to facilitate the pivotal mounting of the brackets 34, the stop member 42 being secured to the body 14 of the guitar. In this regard, a plurality of slots 44 are provided in the stop member 42 for receiving the brackets 34, and the shaft 40 is received through openings in the stop member 42 and through holes in the brackets 34 to pivotally secure the brackets 34 in the slots 44. Of course, it will be recognized that other suitable means can be used for pivotally securing the brackets 34 to the body 14, and the use of the stop member 42 and shaft 40 is simply one preferred means.

In each of the bracket assemblies the second bracket 36 is pivotally secured to the first bracket 34 at a pivot point 45 disposed above the pivot point defined by the shaft 40. Preferably the pivot point 45 is disposed proximate the upper end portions 46 of the bracket 34. And, as illustrated, the pivotal securing of the bracket 36 to the bracket 34 can be accomplished with a suitable fastener such as the illustrated brad 50.

It will also be noted that the upper end portion 48 of the second bracket 36 extends above the pivot point 45 to engage the lever arm 28 of the operatively associated tension adjusting lever 24. As a result, selective pivoting of the second bracket 36 in the direction of arrow 52 pivots the lever 24, increasing the tension on the operatively associated string 17, thus, raising the pitch of the string. Similarly, selective pivoting of the bracket 36 in the direction of arrow 54 pivots the lever 24 in a direction which decreases the tension on the operatively associated string 17, thus, lowers the pitch of the string.

In order to accomplish the desired pivoting of the brackets 34 and 36 actuating means are provided. In the preferred embodiment such actuating means includes one or more pedal assemblies 56 and/or one or more knee lever assemblies 58. The pedal assembly 56 includes a first lever member 60 and a second lever member 62 both secured on a shaft 64 which is pivotally secured to the body 14. A first actuator rod 66 is provided, the rod 66 having a first end portion 68 secured to the first lever member 60 at a point displaced from the rotational axis of the shaft 64, and a second end portion which is releasably secured to the first bracket 34. In this regard, the first bracket 34 is provided with a flange 70 for engaging the rod 66, the flange 70 being disposed above the level of the shaft 40 on which the bracket 34 is mounted, and preferably at the upper end portion 46 of the bracket, proximate the level of the pivot point 45. It will be noted that in the preferred embodiment the flange 70 is provided with a plurality of substantially vertically aligned holes 72, and the rod 66 is received though the hole 72 which is disposed at the desired level and secured with a nut 74 which prohibits the rod 66 from being withdrawn from the hole 72 during operation.

The pedal assembly 56 also includes a pedal 76 which is connected to the second lever member 62 with a linkage 78, the linkage 78 engaging the lever member 62 at a point displaced from the rotational axis of the shaft 64. Thus, it will be appreciated that when the pedal 76 is depressed, the linkage 78 pivots the second lever member 62, which, in turn, pivots the shaft 64. The first lever member 60, also being secured to the shaft 64, is thereby pivoted, resulting in linear travel of the rod 66 in the direction of the arrow 80. This linear travel or pull of the rod 66 is transmitted to the first bracket 34, causing the bracket 34 to pivot at the shaft 40. Together with the bracket 34, the upper end portion 48 of the bracket 36 pivots toward the lever arm 28, thereby increasing the tension on the operatively associated string and raising its pitch. Further, when the pedal 76 is released the tension on the operatively associated string 17 biases the lever arm 28 back to its original position.

In the preferred embodiment the knee lever assembly 58 includes a first lever member 80 and a second lever member 82, both secured on a shaft 84 which is pivotally secured to the body 14. A second actuator rod 86 is provided, the rod 86 having a first end portion 88 secured to the first lever member 80 at a point displaced from the rotational axis of the shaft 84, and a second end portion which is releasably secured to the second bracket 36. The second bracket 36 is provided with a flange 90 for engaging the rod 86, the flange 90 being disposed below the pivot point 45. Further, in the preferred embodiment the flange 90 is provided with a plurality of substantially vertically aligned holes 92, and the rod 86 is received through the hole 92 which is disposed at the desired level and secured with a nut 94 which prohibits the rod 86 from being withdrawn from the hole 92 during operation.

The knee lever assembly 58 also includes a knee lever 96 which is secured to the second lever member 82 at a point displaced from the rotational axis of the shaft 84. Accordingly, when the knee lever 96 is moved in the direction of arrow 98 the knee lever 96 pivots the second lever member 82, which, in turn, pivots the shaft 84. The first lever member 80, also being secured to the shaft 84, is thereby pivoted, resulting in linear travel of the rod 86 in the direction of the arrow 101. This linear travel, or pull, of the rod 86 is transmitted to the second bracket 36, causing the second bracket 36 to pivot at the pivot point 45 and causing the upper end portion 48 of the bracket 36 to pivot away from the lever arm 28. As the upper portion 48 of the bracket 36 moves rearwardly the tension on the string 17 causes the lever arm 28 to pivot, thereby releasing tension on the string and lowering the pitch of the string 17.

It will be noted that a biasing means, such as the spring member 100, is provided for biasing the second bracket 36 and the lever arm 28 back to the original pitch position, the spring 100 being secured at one end to the lower portion of the bracket 36 and at the other end to the body 14. In this regard, the lower stop member 42 serves to stop the second bracket 36 from pivoting too far in the direction of arrow 52 under the biasing of the spring 100, thereby facilitating the return of the tension adjusting lever 24 to the original pitch position.

Further, an upper stop member 102 is secured to the body 14 of the guitar 12 rearward of the first bracket 34 so as to engage the upper portion 46 of the bracket 34 and serve as a stop to restrict the rearward pivoting of the first bracket 34. As best illustrated in FIG. 2, this upper stop member 102 is positioned such that it is engaged by the first bracket 34 when the second bracket 36 is in the original pitch position. Resultantly, whereas the stop member 42 serves to prohibit excess pivoting of the bracket 36 in the direction of arrow 52, the stop member 102 prohibits excess pivoting of the second bracket 36 in the direction of the arrow 54. In this regard, conventional pitch changing devices generally rely only on a spring biasing means such, as the spring 100, to prohibit over rotation of the tension adjusting lever in a direction which lower the pitch of the operatively associated string. However, such biasing means do not properly stabilize the pitch adjustment levers, and as a result the tuning of the various strings can deviate from standard pitch, such that constant tuning of the strings is necessary. It will be recognized that the stop member 102 provides a positive stop means to insure that after the pitch of a string has been changed, it returns to standard pitch. Also, the added stability provided the upper end portion 48 of the second bracket 36 insures that the pitch of an string is not affected by the actuation of the changing device to alter the pitch of an adjacent string.

In light of the above it will be recognized that the present invention provides a pitch changing device for a pedal steel guitar with great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A pitch changing device for a pedal steel guitar, said steel guitar including a body, at least one finger board, and a plurality of strings, said pitch changing device comprising:

at least one tension adjusting lever pivotally mounted on said body anchoring at least one said string, said tension adjusting lever being positionable in a normal pitch position whereby said string is tuned to a desired pitch, said tension adjusting lever also being selectively pivotable in a first direction for increasing tension on said string and selectively pivotable in a second direction for decreasing said tension on said string;

at least one bracket assembly for selectively pivoting said tension adjusting lever, said bracket assembly including a first bracket, said first bracket being pivotally secured at a lower end to said body of said guitar so as to selectively pivot at a first pivot point, said bracket assembly defining a second bracket for engaging said tension adjusting lever, said second bracket being pivotally secured proximate a midpoint to an upper end of said first bracket at a second pivot point displaced toward said strings from said first pivot point, said first bracket being pivotable from said first pivot point in a first direction for moving said second bracket against said tension adjusting lever so as to move said tension adjusting lever in said first direction for increasing said tension on said string, and pivotable in a second direction for returning said tension adjusting lever to said normal pitch position, said second bracket being pivotable from said second pivot point in a first direction for allowing said tension adjusting lever to move in said second direction so as to decrease said tension on said strings, and pivotable in a second direction for moving said tension adjusting lever to said normal pitch position;

a first stop means on said body for engaging said upper end of said first bracket to prevent excessive pivoting of said second bracket in a direction to reduce said tension of said strings and for terminating the travel of said first bracket in said second direction at a point operatively associated with said normal pitch position of said tension adjusting lever;

a second stop means on said body for engaging a lower end of said second bracket to prevent excessive pivoting of said second bracket in a direction to increase said tension of said strings and for terminating the travel of said second bracket in said second direction at a point operatively associated with said normal pitch position of said tension adjusting lever; and actuating means for selectively pivoting said first and second brackets.

2. The pitch changing device of claim 1 wherein said second bracket member is provided with biasing means for biasing said second bracket in said second direction to facilitate the return of said tension adjusting lever to said normal pitch position.

3. The pitch changing device of claim 1 wherein said tension adjusting lever is provided with a lever arm for engaging said second bracket.

4. The tension changing device of claim 1 wherein said second bracket member is provided with biasing means for biasing said second bracket in said second direction to facilitate the return of said pitch adjusting lever to said normal pitch position, said biasing means including a spring member having a first end portion secured to said body and a second end portion secured to said lower end portion of said second bracket.

5. The pitch changing device of claim 4 wherein said tension adjusting lever is provided with a lever arm for engaging said upper end portion of said second bracket.

6. The pitch changing device of claim 1 wherein said device includes a first actuating means for engaging and selectively pivoting said first bracket and a second actuating means for engaging and selectively pivoting said second bracket.

7. The pitch changing device of claim 6 wherein said first bracket is provided at its upper end portion with a flange for engaging said first actuating means, and said second bracket is provided with a further flange disposed below said second pivot point for engaging said second actuating means.

8. A pitch changing device for a pedal steel guitar, said steel guitar including a body, at least one finger board, and a plurality of strings, and pitch changing device comprising:

at least one tension adjusting lever pivotally mounted on said body for anchoring at least one said string, said tension adjusting lever having a lever arm, said tension adjusting lever being positionable in a normal pitch position whereby said string is tuned to a desired pitch, said tension adjusting lever also being selectively pivotable in a first direction for increasing tension on said string and selectively pivotable in a second direction for decreasing said tension of said string;

at least one bracket assembly for selectively pivoting said tension adjusting lever, said bracket assembly including a first bracket having upper and lower end portions, said first bracket being pivotally secured to said body of said guitar proximate said lower end portion of said first bracket so as to selectively pivot at a first pivot point, said bracket assembly defining a second bracket having an upper end portion for engaging said lever arm of said tension adjusting lever and having a second end portion, said second bracket being pivotally secured to said first bracket at a second pivot point disposed above said first pivot point, said first bracket being pivotable from said first pivot point in a first direction for moving said upper end portion of said second bracket against said lever arm of said tension adjusting lever so as to move said tension adjusting lever in said first direction for increasing said tension on said string, and pivotable in a second direction for returning said tension adjusting lever to said normal pitch position, said second bracket being pivotable from said second pivot point in a first direction for allowing said tension adjusting lever to move in said second direction so as to decrease said tension on said strings, and pivotable in a second direction for moving said tension adjusting lever to said normal pitch position, said first bracket being provided proximate said upper end portion of said first bracket with a first actuator engaging flange, and said second bracket being provided with a second actuator engaging flange disposed below said second pivot point and below said first actuator engaging flange;

biasing means attached between said body and said second bracket for biasing said second bracket in said second direction to facilitate return of said tension adjusting lever to said normal pitch position;

a first stop means on said body for engaging said upper end portion of said first bracket and for terminating rotation of said first bracket in said second direction at a point operatively associated with said normal pitch position of said tension adjusting lever to prevent excessive pivoting of said second bracket in a direction to reduce said tension of said strings;

a second stop means on said body for engaging said lower end portion of said second bracket and for terminating rotation of said second bracket in said second direction at a point operatively associated with said normal pitch position of said tension adjusting lever to prevent excessive pivoting of said second bracket in a direction to increase said tension of said strings;

a first actuating means attached to said first actuator engaging flange for selectively pivoting said first bracket; and a second actuating means attached to said second actuator engaging flange for selectively pivoting said second bracket.

* * * * *